United States Patent [19]

Hill

[11] 3,939,037

[45] *Feb. 17, 1976

[54] HEADBOX WITH FLEXIBLE TRAILING ELEMENTS

[75] Inventor: Lester M. Hill, Cassville, Wis.

[73] Assignee: Beloit Corporation, Beloit, Wis.

[ * ] Notice: The portion of the term of this patent subsequent to Sept. 21, 1988, has been disclaimed.

[22] Filed: Mar. 14, 1974

[21] Appl. No.: 451,225

Related U.S. Application Data

[60] Continuation of Ser. No. 345,436, March 27, 1973, abandoned, which is a continuation-in-part of Ser. No. 121,775, March 8, 1971, abandoned, which is a division of Ser. No. 698,633, Jan. 17, 1968, Pat. No. 3,607,625.

[52] U.S. Cl. ..... 162/341; 162/343

[51] Int. Cl.[2] ..... D21F 1/02

[58] Field of Search ..... 162/343, 341, 336, 212, 162/216

[56] References Cited

UNITED STATES PATENTS 3,607,625 9/1971 Hill et al. ..... 162/343

R28,269 12/1974 Hill et al. ..... 162/343

FOREIGN PATENTS OR APPLICATIONS 1,490,429 6/1967 France ..... 162/343

*Primary Examiner*—S. Leon Bashore
*Assistant Examiner*—Richard V. Fisher
*Attorney, Agent, or Firm*—Dirk J. Veneman; Bruce L. Samlan; Gerald A. Mathews

[57] ABSTRACT

A headbox construction for a papermaking machine which comprises a slice chamber connected to a preslice flow chamber by means of a perforate member. The slice chamber contains a plurality of plates and/or filaments attached to said perforate member and extend in the direction of stock flow through said slice chamber and define therein a multiplicity of relatively narrow channels of decreasing cross-sectional area in the direction of flow.

13 Claims, 3 Drawing Figures

HEADBOX WITH FLEXIBLE TRAILING ELEMENTS

CROSS-REFERENCE TO RELATED APPLICATION

This application is a continuation of Ser. No. 345,436, filed Mar. 27, 1973, now abandoned; which in turn is a continuation-in-part of Ser. No. 121,775, filed Mar. 8, 1971, now abandoned; which in turn is a divisional of Ser. No. 698,633, filed Jan. 17, 1968, now U.S. Pat. No. 3,607,625; which in turn was subject to re-issue application Ser. No. 355,544, filed Apr. 30, 1973, now U.S. Pat. No. Re 28,269.

This invention relates generally to a headbox for a papermaking machine, and more particularly to a headbox construction in which the slice chamber includes a plurality of passages formed by elements extending in the direction of stock flow to uniformly direct stock towards the slice opening at the downstream end of said slice chamber.

In the Fourdrinier papermaking process, the principal difficulty in achieving uniform formation of a paper web is the natural tendency of the fibers to flocculate. An important feature of all Fourdrinier machine designs therefore is a means to disperse the fiber networks during the period of sheet formation. At the present time, dispersion of the fiber network is effected by generating turbulence, used in a broad sense, in the fiber suspension both in the headbox, frequently through the use of rectifier rolls, and on the Fourdrinier table as a consequence of the reaction of the free surface of the stock to the variable acceleration over table rolls and foils. The dispersing activity that occurs on the Fourdrinier table is an important supplement to the turbulence generated in the headbox and as a rule, the drainage on a Fourdrinier table is deliberately retarded to allow sufficient treatment of the undrained suspension to obtain uniform formation. On a Fourdrinier in which the table rolls have been replaced by suction boxes, on the other hand, the fiber suspension is drained comparatively much more rapidly with considerably less activity generated in the undrained suspension. It follows that the formation of the sheet formed on a suction box or flat box Fourdrinier is much more sensitive to the characteristics of the headbox discharge than that of a conventionally formed sheet.

A basic limitation in headbox design has been that the means for generating turbulence in fiber suspensions in order to disperse them have been comparatively large scale devices only. With such devices, it is possible to develop small scale turbulence by increasing the intensity of turbulence generated. Thus the turbulence energy is transferred naturally from large to small scales and the higher the intensity, the greater the rate of energy transfer and hence, the smaller the scales of turbulence sustained. However, a detrimental effect also ensured from this high intensity large scale turbulence namely the large waves and free surface disturbances developed on the Fourdrinier table. Thus a general rule of headbox performance has been that the degree of dispersion and level of turbulence in the headbox discharge were closely correlated; the higher the turbulence, the better the dispersion.

In selecting a headbox design under this limiting condition then, one could choose at the extremes, either a design that produces a highly turbulent, well dispersed discharge, or one that produces a low turbulent, poorly dispersed discharge. Since either a very high level of turbulence or a very low level (and consequent poor dispersion) produce defects in sheet formation on the Fourdrinier machine, the art of headbox design has consisted of making a suitable compromise between these two extremes. That is, a primary objective of headbox design up to this time has been to generate a level of turbulence which was high enough for dispersion, but low enough to avoid free surface defects during the formation period. It will be appreciated that the best compromise would be different for different types of papermaking furnishes, consistencies, Fourdrinier table design, machine speed, etc. Thus a universal headbox design with presently available devices and techniques would be difficult, if not impossible to establish. Furthermore, because these compromises always sacrifice the best possible dispersion and/or the best possible flow pattern on the Fourdrinier wire, it is deemed that there is a great potential for improvement in headbox design today.

The defects in sheet formation as a result of these extremes in headbox design, i.e., very high or very low turbulence, are even more marked when a Fourdrinier is used wherein all table rolls and foils are replaced by suction boxes. Thus when the turbulence is very low, as for example in the discharge from a conventional rectifier roll type headbox, the formation of the sheet formed by the rapid drainage over suction boxes in the absence of the table roll activity directly reflects the poor dispersion in the discharge jet. On the other hand, when the turbulence is very high, a wave pattern is generated in the free surface of the flow on the wire as a consequence of the turbulence. With rapid drainage of the suspension in this case, the formation of the sheet reflects the mass distribution pattern of these waves. In addition to the free surface wave patterns, excessive turbulence may also entrain air and disrupt the thickened fiber mat which had been deposited earlier and cause formation defects.

Thus not only are the present extremes of headbox characteristics unsuitable, but it is also difficult to find a suitable compromise for a suction box Fourdrinier application.

The unique and novel combination of elements of the present invention provide for delivery of the stock slurry to a forming surface of a papermaking machine having a high degree of fiber dispersion with a low level of turbulence in the discharge jet. Under these conditions, a fine scale dispersion of the fibers is produced which will not deteriorate as the turbulence decays away; at least it will not deteriorate to the extent that occurs in the turbulent dispersions which are produced by conventional headbox designs. It has been found that it is the absence of large scale turbulence which precludes the gross reflocculation of the fibers since flocculation is predominately a consequence of small scale turbulence decay and the persistence of the large scales. Sustaining the dispersion in the flow on the Fourdriner wire then, leads directly to improved formation.

The method by which the above is accomplished, that is, to produce a fine scale turbulence without large scale eddies, is to pass the fiber suspension through a system of parallel channels of uniform small size but large in percentage open area. Both of these conditions, uniform small channel size and large exit percentage open area, are necessary. Thus the largest scales of turbulence developed in the channel flow have the same order of size as the depth of the individual channels and by maintaining the individual channel depth small, the resulting scale of turbulence will be small. It is necessary to have a large exit percentage open area to prevent the development of large scales of turbulence in the zone of discharge. That is, large solid areas between the channels' exits, would result in large scale turbulence in the wake of those areas.

In concept then, the flow channels must change from a large entrance to a small exit size. This change should occur over a substantial distance to allow time for the large scale coarse flow disturbances generated in the wake of the entrance structure to be degraded to the small scale turbulence desired.

It is therefore an important object of the present invention to provide for a stock delivery system in the form of a headbox for delivering papermaking stock to the forming surface of the papermaking machine under conditons of maximum dispersion with a minimum of turbulence in the discharge jet.

Another object of the present invention is to provide a headbox for a papermaking machine which produces a fine scale dispersion of the fibers which dispersion will not deteriorate excessively as the turbulence decays away.

Additional objects, advantages and features of the present invention are apparent from the preceding description and will become more apparent as this specification proceeds with reference to the accompanying drawing in which.

AS SHOWN ON THE DRAWINGS

As the terms are used herein, transverse refers to the cross-machine direction whereas longitudinal refers to the so called machine direction.

Figure 1:
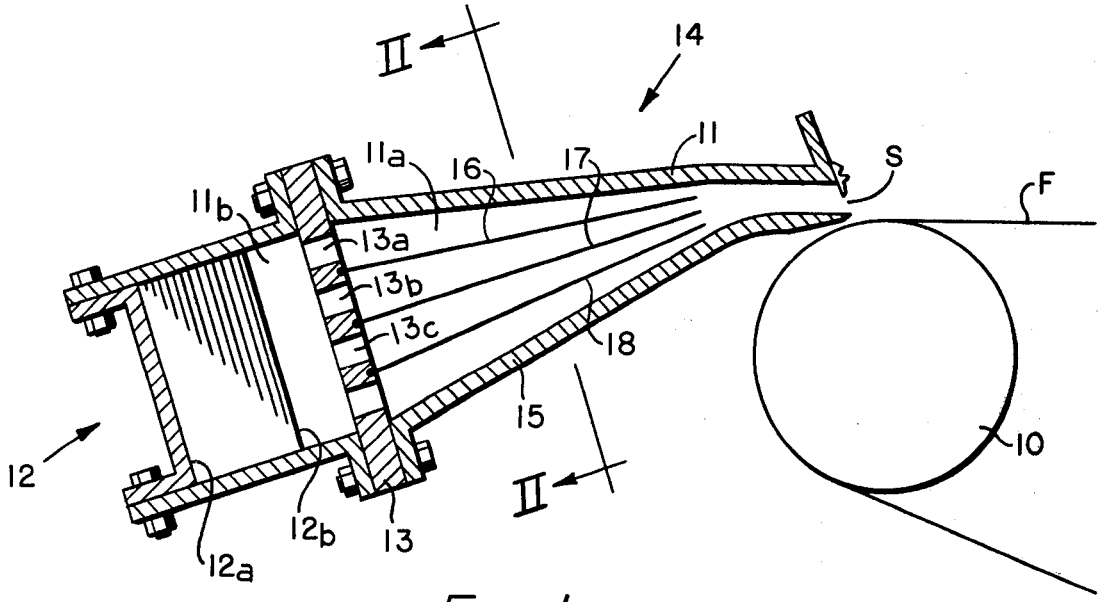
FIG. 1 is an elevational sectional view showing a headbox construction for use in the practice of the present invention.

In FIG. 1, it will be seen that there is shown a forming wire F traveling around a breast roll 10 to define a conventional forming surface onto which papermaking stock is fed through a slice opening indicated generally at S. The slice S is mounted at the forward end of a headbox indicated generally at 11 and including a slice chamber 11*a*.

In a conventional stock inlet the stock is generally fed to the headbox, such as the one here employed, from a fan pump or other suitable source of stock in a relatively small high speed conduit which is indicated in FIG. 1 by the reference numeral 12 as a tapered cross machine header having an inlet 12*a* at the side of the headbox 11 from which it is viewed in FIG. 1 and an outlet 12*b* of diminished cross sectional area at the backside of the chamber 12 for flow of stock in a generally transverse direction through the tapered inlet header 12. Any of a number of known stock inlet devices may be provided to present a transverse flow of stock into the chamber 12 under a substantially uniform pressure in the general area of the barrier or perforated mounting plate indicated at 13. The perforated plate 13 extends transversely of the stock inlet 12 and it is provided with a plurality of apertures 13*a*, 13*b*, 13*c*, etc. which are generally parallel and which are spaced transversely to define a multiplicity of generally parallel apertures extending across the entire plate 13. These apertures are preferably in the form of orifices and provide for open communication between the inlet header 12 and the slice chamber 11*a*. The slice chamber 11*a* comprises top 14 and bottom 15 walls converging in the longitudinal or machine direction and terminating at the slice portion S1. Appropriate transversely spaced sidewalls are provided at the front and rear end of the slice chamber. Extending longitudinally within the slice chamber 11*a* are a plurality of trailing elements 16, 17, 18, etc. One end of each of these trailing elements is attached to the perforated plate 13 at the upstream end of the slice chamber 11*a*. The trailing elements extend for approximately the fully length of the slice chamber.

The trailing elements are thus permitted to float freely within the slice chamber with the exception of their restriction at the point of attachment to the perforated plate 13. With papermaking stock flowing through the slice chamber the trailing elements will form a multiplicity of longitudinally extending flexible channels through which the papermaking stock will flow thereby gradually reducing large scale turbulence in the papermaking stock while maintaining a high degree of fiber dispersion. The thus conditioned papermaking stock exits through the slice opening S1 and is deposited on the Fourdrinier wire F or on any other appropriate web forming surface. The Fourdrinier wire F is supported immediately beneath the slice by roll 10, commonly referred to as a breast roll.

Figure 2:
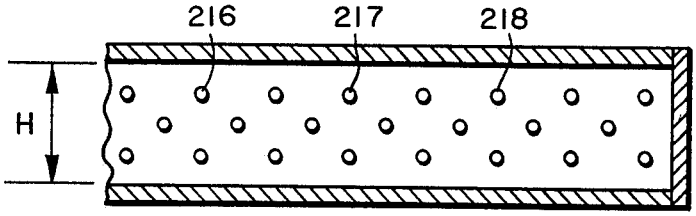
FIG. 2 is a cross-sectional view taken along the lines II—II of FIG. 1.
Figure 3:
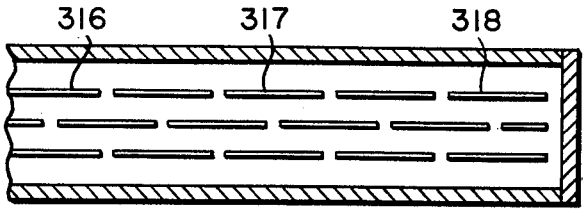
FIG. 3 is a cross-sectional view taken along the lines II—II of FIG. 1 and showing modification of the present invention.

As shown in FIGS. 2 and 3, the trailing members may have different forms each of which can be readily adapted to suit a particular operating condition. For example, as will be readily apparent to those skilled in the art it may be more convenient to have the flexible members 16, 17, and 18, etc., extend transversely of the slice chamber in the form of a full width sheet, as described in connection with FIG. 1, where the transverse dimension of the preslice flow chamber is relatively narrow. On the other hand, it will be apparent that in extremely wide headboxes it may be more practical to have a plurality of relatively narrow sheets extending in the transverse direction of the slice chamber.

As shown in FIGS. 2 and 3, the trailing members may have different forms each of which can be readily adapted to suit a particular operating condition. For example, as shown in FIG. 2 the trailing elements may be in the form of rods or wires 216, 217, 218, etc., having a generally circular cross-sectional area. This embodiment is particularly useful where stock characteristics require the use of channels of extremely small cross-sectional area.

As shown in FIG. 3, the trailing elements may be in the form of ribbons 316, 317, 318, etc., having a generally rectangular cross-sectional area. The transverse dimension of the ribbons is less than or a fraction of the transverse dimension of the slice chamber 11*a* which may be a more practical approach for headboxes having a relatively large transverse dimension. A number of such elements may be positioned transversely of the height H of the stock stream.

Thus it will be seen that an improved headbox has been provided which achieves the objectives and advantages set forth and overcomes the disadvantages associated with prior art systems thereby obtaining a result heretofore unobtainable.

While it is theoretically desirable to construct the aforementioned trailing members so that they are flexible it should be understood that a practical and workable solution may use relatively rigid trailing members. The material used for such members may be metal or non-metal such as plastics, rubber, epoxy resins, etc.

The drawings and specification present a detailed disclosure of the preferred embodiments mentioned and it is to be understood that the invention is not limited to the specific form disclosed, but covers all modifications, changes and alternative constructions and methods falling within the scope and principles taught by the invention.

I claim as my invention:

1. In a headbox for delivering stock to a forming surface, the headbox having a slice chamber and a slice opening, the improvement comprising:

a flexible element positioned in the slice chamber for stock flow induced movement and extending in the direction of stock flow, and means supporting said element in the slice chamber with its downstream portion unattached, whereby a fine scale turbulence is produced in the stock without large scale eddies.

2. In a headbox for delivering stock to a forming surface, the headbox having a slice chamber and a slice opening, the improvement comprising:

a flexible element positioned in the slice chamber for stock flow induced movement and extending in the direction of stock flow, said element extending transversely of the slice chamber, and means supporting said element in the slice chamber with its downstream edge unattached, whereby a fine scale turbulence is produced in the stock without large scale eddies.

3. In a headbox for delivering stock to a forming surface, the headbox having a slice chamber and a slice opening, the improvement comprising:

a plurality of flexible elements positioned in the slice chamber for stock flow induced movement and extending in the direction of stock flow, and means supporting said elements in the slice chamber with their downstream portions unattached, whereby a fine scale turbulence is produced in the stock without large scale eddies.

4. In a headbox for delivering stock to a forming surface, the headbox having a slice chamber and a slice opening, the improvement comprising:

a plurality of flexible elements positioned in the slice chamber for stock flow induced movement, said elements extending transversely of said slice chamber, and means supporting said elements in the slice chamber with their downstream edges unattached, whereby a fine scale turbulence is produced in the stock without large scale eddies.

5. The structure of claim 4 wherein said flexible elements are in the form of ribbons.

6. The structure of claim 4 wherein said flexible elements are in the form of ribbons having a generally rectangular cross-sectional area.

7. The structure of claim 4 wherein said flexible elements are in the form of wires.

8. The structure of claim 4 wherein said flexible elements are in the form of wires having a generally circular cross-sectional area.

9. In a headbox for delivering a stream of stock to a forming surface, the headbox having a slice chamber and a slice opening, the improvement comprising:

a plurality of flexible elements positioned in the slice chamber for stock flow induced movement at locations extending transversely of the height of the stock stream, and means anchoring said elements at their upstream ends with their downstream portions unattached, whereby a fine scale turbulence is produced in the stock without large scale eddies.

10. In a headbox for delivering stock to a forming surface, the headbox having a slice chamber and a slice opening, the improvement comprising:

a plurality of trailing elements positioned in the slice chamber for stock flow induced movement, each of said elements extending transversely of said headbox, and means anchoring said elements only at their upstream ends at locations spaced generally perpendicular to the stock-flow stream with their downstream portions unattached and constructed to be self-positionable so as to be solely responsive to forces exerted thereon by the stock flowing towards the slice, whereby a fine scale turbulence is produced in the stock without large scale eddies.

11. In a headbox for delivering stock to a forming surface, the headbox having a slice chamber and a slice opening, the improvement comprising:

a trailing element positioned in the slice chamber for stock flow induced movement, said element extending transversely of said headbox, and means anchoring said element only at its upstream end with its downstream portion unattached and constructed to be self-positionable so as to be solely responsive to forces exerted thereon by the stock flowing towards the slice, whereby a fine scale turbulence is produced in the stock without large scale eddies.

12. The structure of claim 11 wherein the trailing element comprises a plurality of rods.

13. The structure of claim 12 wherein the rods have a generally circular cross-sectional area.

* * * * *